US008219367B2

(12) United States Patent
Iwata et al.

(10) Patent No.: US 8,219,367 B2
(45) Date of Patent: Jul. 10, 2012

(54) METHOD OF ESTIMATING INFORMATION ON PROJECTION CONDITIONS BY A PROJECTION MACHINE AND A DEVICE THEREOF

(75) Inventors: Kyoichi Iwata, Toyokawa (JP); Hiroyasu Makino, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 789 days.

(21) Appl. No.: 12/086,762

(22) PCT Filed: Dec. 20, 2006

(86) PCT No.: PCT/JP2006/325387

§ 371 (c)(1),
(2), (4) Date: Dec. 10, 2008

(87) PCT Pub. No.: WO2007/072863

PCT Pub. Date: Jun. 28, 2007

(65) Prior Publication Data

US 2009/0222244 A1 Sep. 3, 2009

(30) Foreign Application Priority Data

Dec. 20, 2005 (JP) ..... 2005-365657
Jan. 18, 2006 (JP) ..... 2006-009624
Mar. 1, 2006 (JP) ..... 2006-054444

(51) Int. Cl.
*G06G 7/48* (2006.01)

(52) U.S. Cl. ..... 703/6; 703/7

(58) Field of Classification Search ..... 703/6, 7; 451/38, 81, 5, 540, 136, 41, 527; 427/249.8; 204/212; 205/97, 663; 110/342; 494/67; 353/28; 399/350; 137/15.25; 118/730
See application file for complete search history.

(56) References Cited

U.S. PATENT DOCUMENTS 3,735,532 A * 5/1973 Long, III ..... 451/81
5,368,890 A * 11/1994 de Nagybaczon ..... 427/249.8
6,102,777 A * 8/2000 Duescher et al. ..... 451/36
6,120,352 A * 9/2000 Duescher ..... 451/41
6,132,519 A * 10/2000 Ohashi et al. ..... 118/730
6,413,403 B1 * 7/2002 Lindquist et al. ..... 205/97
6,568,417 B2 * 5/2003 Laney ..... 137/15.25
7,144,303 B2 * 12/2006 Kamimura et al. ..... 451/38
7,288,020 B1 * 10/2007 Kiku ..... 451/38
7,378,004 B2 * 5/2008 Uzoh et al. ..... 204/212
2001/0002362 A1 * 5/2001 Guiselin ..... 451/540

(Continued)

FOREIGN PATENT DOCUMENTS

JP 61-76272 A 4/1986
JP 1-264773 10/1989
JP 8-323629 A 12/1996
JP 2002-166369 A 6/2002
JP 2003-159651 A 6/2003
JP 2003 340721 12/2003

*Primary Examiner* — Kandasamy Thangavelu
(74) *Attorney, Agent, or Firm* — Finnegan, Henderson, Farabow, Garrett & Dunner, L.L.P.

(57) ABSTRACT

A method of estimating information on the projection states of projection elements (P) by using an analysis model in which discharged projection elements (P) repeatedly collided with rotation blades (13) in a projection machine having rotating blades (13). The method includes the steps of determining initial conditions including information on the size and rotation of blades (13), discharging information on the projection elements(P), and information on projection elements with respect to the blades (13) the step of storing the initial conditions, a computing step of computing the position of each projection element (P), and its velocity and direction after collision with a blade(13) based on the initial conditions, and the step of estimating information on projection state based on computation results.

23 Claims, 14 Drawing Sheets

U.S. PATENT DOCUMENTS

2002/0020621 A1* 2/2002 Uzoh et al. ..... 204/212
2002/0061723 A1* 5/2002 Duescher ..... 451/527
2003/0118383 A1* 6/2003 Endo et al. ..... 399/350
2004/0021828 A1* 2/2004 Evans et al. ..... 353/28
2004/0121892 A1* 6/2004 Zonneveld et al. ..... 494/67
2004/0134793 A1* 7/2004 Uzoh et al. ..... 205/663
2004/0157530 A1* 8/2004 Omata et al. ..... 451/5
2004/0237860 A1* 12/2004 Miyoshi et al. ..... 110/342
2005/0118939 A1* 6/2005 Duescher ..... 451/527

* cited by examiner

METHOD OF ESTIMATING INFORMATION ON PROJECTION CONDITIONS BY A PROJECTION MACHINE AND A DEVICE THEREOF

FIELD OF THE INVENTION

This invention generally relates to a method and a system for estimating information on projection conditions for projecting abrasive particles by a projection machine. More particularly, this invention relates to a method and a system that enables information to be estimated on the conditions of the projection without a trial for manufacturing parts of the projection machine.

BACKGROUND OF THE INVENTION

In a surface-treatment device such as a shot-peening machine, it is preferable to set optimal projection conditions of abrasive particles to be projected by a projection device based on the shape of an article to be processed and the area of the surface to be processed, etc. The projection conditions of the abrasive particles in this context include the area to be shot-peened or the distribution of the shot-peening, as well as the amount and the velocity of the abrasive particles to be projected. To this end, Japanese Patent Early-Publication No. 1996-323629 (prior art 1), by the assignor of the present application, discloses a method and an apparatus for regulating the distribution of the shot peened based on the article to be processed when the quantity and the velocity of the abrasive particles to be projected are changed based on that article to be processed.

As another prior-art publication, a shot-peening machine is disclosed in Japanese Patent Early-Publication No. 1989-264773 (prior art 2). It limits the distribution of the shot peened by projecting the abrasive particles of the shot peened in a distribution that is wider than the surface to be processed and by providing a so called vane as a liner between the projection device and the article to be processed, to limit the range of the projection of the abrasive particles.

Further, the apparatus disclosed in Japanese Patent Early-Publication No. 2003-340721(prior art 3) is configured to concentrate the distribution of the abrasive particles within a predetermined range by shortening the length of a blade so as to maintain the constant direction of the projection without using a vane.

However, in the disclosures of prior art 1, deciding the distribution and the velocity of the projection necessitates a centrifugal projecting device that actually projects the abrasive particles to the article to be processed to confirm the distribution and the velocity of the abrasive particles based on the result of the actual projecting. Therefore, it necessitates time to obtain an accurate relationship between the optimum processing and the distribution of the projection. Desirably, the centrifugal projecting device will provide for distribution of the projection that is best suited for articles to be processed and for the processing method in the centrifugal projection device, because saving energy and an efficient projection are needed. From this viewpoint, it is inconvenient to require time to understand an accurate relationship between the optimum processing and the distribution of the projection.

Moreover, because the vane is worn out by the collisions with the abrasive particles, thus a vane that restricts the range of the projection may change this range in the device of prior art 2. So it might cause the quality of the articles for processing to decrease. Therefore, it is frequently necessary to exchange a vane. Moreover, because the abrasive particle is reflected from the vane, and the particle rebounds in the inner wall of the projection chamber, the protection from wear from the wall of the projection chamber is also necessary.

In contrast, in the device of prior art 3 the difference is caused at the position of the blade where the supply of the abrasive particles is not constant, each part of the abrasive particles collides, and the distribution of the projection diffuses though the length of the blade and is extremely shortened, to concentrate the distribution of the projection to a predetermined range. Therefore, it is easy to receive the effect when the supply of the abrasive particles is unstable. Moreover, the slower the velocity is of the rotation of the impeller, possibly the efficiency of the treatment decreases, because abrasive particles that are dispersed outside of the impeller without colliding with the blade are generated. In addition, because it greatly affects the accuracy of the distribution of the projection when the shape of the blade changes by the wear, and because the blade is worn out by the collisions with the abrasive particles, it is necessary to frequently exchange the blades.

Accordingly, one object of the present invention is to provide a method and a system for estimating information on the state of the projection of abrasive particles projected by a projection machine to reduce operating costs and the time to know conditions involving the state of the projection of the abrasive particles to define information on a specified state, e.g., at least the distribution of the projection or the velocity of the projection.

SUMMARY OF THE INVENTION

One aspect of the present invention provides a method of estimating information on the state of the projection of abrasive particles projected by a projection machine that includes a plurality of blades that rotate at a high rate. The method comprises the steps of analyzing the behavior of the abrasive particles projected by the projection machine on the blades, to create an analytical model, and estimate the information on the state of the projection of the abrasive particles projected by the projection machine using the analytical model.

The action of each abrasive particle includes contact with at least one other abrasive particle and one of the rotating blades.

Another aspect of the present invention provides a method of estimating information on the state of the projection of abrasive particles projected by a projection machine that includes a plurality of blades that rotate at a high rate, and an opening through which the abrasive particles are projected by the blades to an article to be processed. The method comprises the steps of determining the initial conditions. They include information on the size, and the rate of the rotation of, the blades, information on the projection of the abrasive particles, information on the abrasive particles in relation to the blades; storing the initial conditions; calculating the positions of each abrasive particle, and the velocities and directions of the abrasive particles after collisions with the blades, based on the initial conditions; and estimating the information on the state of the projection based on the result of the calculation.

The result of the calculation may be displayed.

Yet another aspect of the present invention provides a system with a programmed computer to estimate information on the state of the projection of the abrasive particles projected by a projection machine that includes a plurality of blades that rotate at a high rate. The computer comprises a) input means for providing to the computer initial conditions that include information on the size and rotation of the blades, information on the projection of the abrasive particles, information on the abrasive particles in relation to the blades; b) calculating means for calculating the position of each abrasive particle, and the velocities and directions of the abrasive particles after collisions with the blades, based on the initial conditions; c) means for estimating the information on the state of the projection based on the result of the calculation; and d) means for displaying the assumed estimated information.

In one embodiment of the present invention, the calculating means calculates the magnitude of a force of contact of each abrasive particle relative to at least one of the blades and the other abrasive particles; and calculates the acceleration of the abrasive particle based on the forces that act on it. They include the force of the contact and the gravity, and obtaining the velocity and the position of the abrasive particle after a short time, based on the calculated acceleration.

The computer may further include a storage medium in which a program for calculation to be executed by the calculation means is stored.

The calculating step and the calculating means in the method of the second aspect and the system of the third aspect of the present invention express the velocity of each abrasive particle after a collision as a relative velocity that includes a vertical component along a Y-axis and a horizontal component along an X-axis using the transfer vector of the abrasive particle and the transfer vector of the point of collision on a surface of the corresponding blade on which the abrasive particle is impacted, wherein the vertical component of the relative velocity is expressed by a bounce that uses the coefficient of the rebound by a determination of a coefficient, and wherein the horizontal component is expressed as a loss of velocity due to resistance from friction by a determination of a coefficient; and calculates the velocity and the direction of the abrasive particle after a collision with the corresponding blade by summing them plus calculating the transfer vector of the blade at the point of the collision. In this case, the step for calculating, or the calculating means, may calculate the distance the abrasive particle moves and the distance the corresponding blade moves in a sampling time, and executes the calculation relating to the collision for an abrasive particle that complies with sequential conditions of collisions.

The method of the system of another aspect of the present invention may adjust a profile of the distribution of the projection of the abrasive particles to a predetermined profile by selecting the values of each blade, the range of the positions of the projections on the opening from which the abrasive particles are projected, and the rate of rotation of the blade such that the variability of the frequency to which each discharged abrasive particle rebounds from the blade is a predetermined value or less. Preferably, the predetermined value is 0.3.

The values of the dimensions include a ratio of the inner diameter and the outer diameter of the blade, the range of this ratio preferably being any one of 1.75 to 2.0, 2.5 to 2.9, and 3.6 to 4.1.

In the above aspects of the present invention, the information on the state of the projection of the abrasive particles is at least either a distribution of the projection of the abrasive particles or the velocity of the projection of the abrasive particles. The projection machine may, for instance, be a centrifugal projecting device.

The present invention further provides a method aided by a programmed computer for controlling the projection of abrasive particles to be projected to an article by a projection machine that includes a plurality of blades that rotate at a high rate, and for estimating information on the state of the projection of the abrasive particles. The method comprises the steps of a) entering information on the blade, the condition of the projection of the abrasive particles, and the coefficient of bounce and the coefficient for the resistance to friction of the abrasive particle to the computer; b) determining by the computer whether entering the entering step has been completed, and calculating by the computer positions of respective abrasive particles per a given sampling time based on the sampling time and the transfer vector of the abrasive particle, if the entering is completed; c) turning the blades by the computer to update the angles of the blades; d) determining by the computer whether each abrasive particle impacts the corresponding blade, calculating by the computer the velocity and the direction of the impacted abrasive particle to update the transfer vector of the abrasive particle, if the computer determines the abrasive particle impacts the corresponding blade, while maintaining the transfer vector, if the computer determines no abrasive particle impacts the corresponding blade; e) determining by the computer whether the position of the blades is within a range from which the abrasive particles are discharged, discharging the abrasive particles, if the position of the blades is within the range from which the abrasive particles are discharged, while preventing the abrasive particles from being discharged, if the positions of the blades are outside the range from which the abrasive particles are discharged, f) determining by the computer whether the positions of the blades have been turned to the predetermined positions, totaling the transfer vectors of the respective abrasive particles, if the determination indicates that the positions of the blades have been turned to the predetermined positions, while repeating steps b) to f), if the determination indicates that the positions of the blades have not turned to the predetermined position; and g) displaying by the computer the distribution of the projection and the velocity of the projection and of the result of the calculations for the total.

The above and other scopes and advantages of the present invention will become apparent by reviewing the following detailed description with reference to the accompanying drawings.

DETAILED DESCRIPTION OF THE PREFERRED EMBODIMENTS

One embodiment of the present invention that is applicable to a centrifugal projecting device that projects centrifugally will now be explained. The machine that projects centrifugally is a projection machine that includes an impeller having a plurality of blades and a cylindrical control cage arranged in the interior of the impeller. Abrasive particles are impelled through an opening of the control cage and are projected to an article to be processed by rotating the impeller at a high rate. However, this invention is not limited to such a machine that projects centrifugally.

First, an initial experiment is carried out to investigate the action of one abrasive particle freely released from the control cage of the machine that projects centrifugally at one rotating blade. In the initial experiment, the action of the abrasive particle on the blade was evidenced using an impact paper.

Figure 1:
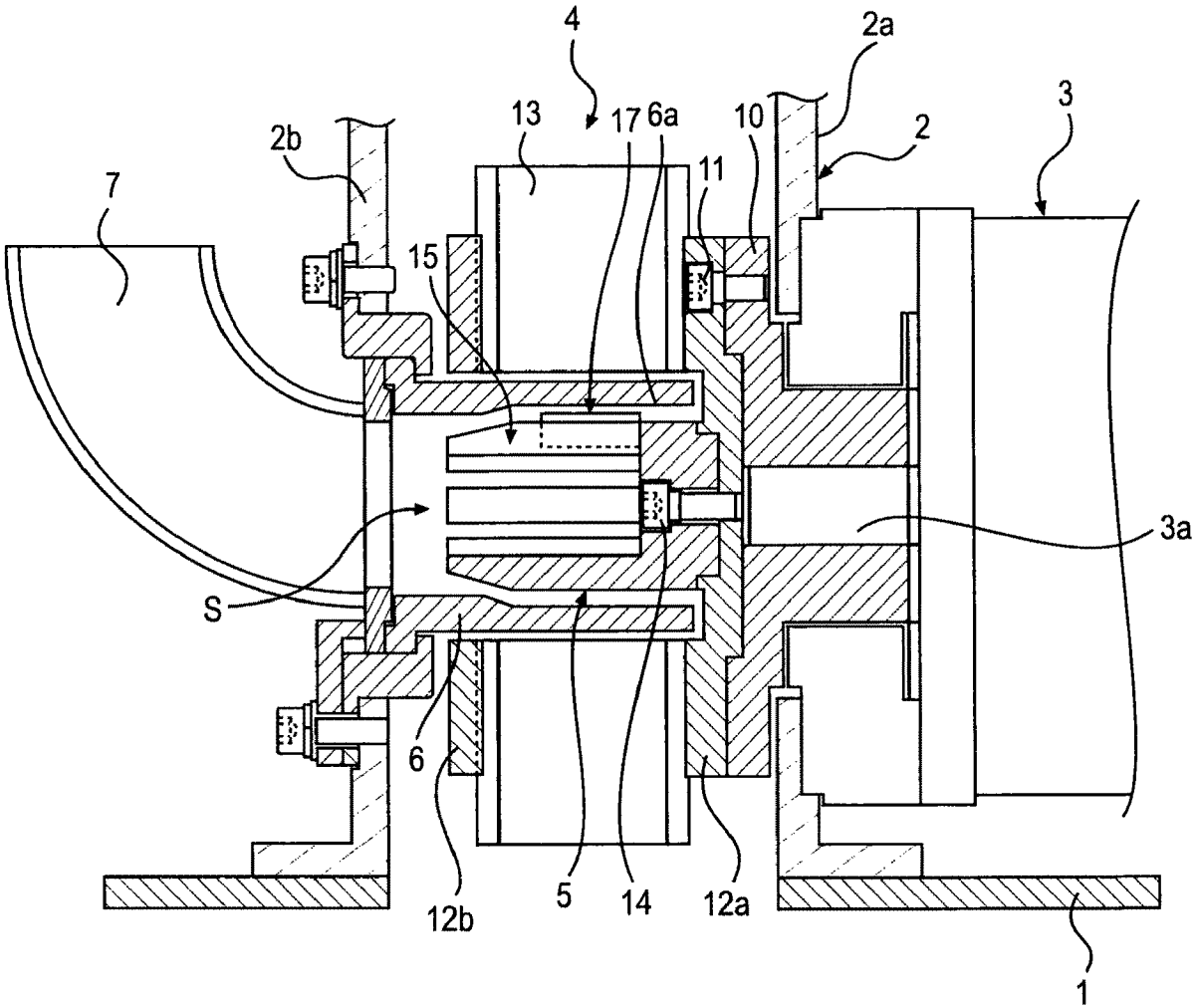
FIG. 1 shows a cross-sectional view of an essential part of a centrifugal projecting device to illustrate one example of a projection machine to which the present invention can be applied.

As shown in FIG. 1, the machine that projects centrifugally that is used for the initial experiment includes a housing (an impeller casing) 2 mounted on an upper wall 1 on the ceiling of the protecting cavity of the main unit of the project machine, a driving mechanism 3 on the upper wall 1 on the outside of a first sidewall 2*a* of the housing 2, and an impeller 4 mounted on a shaft 3*a* for driving the driving mechanism 3. The centrifugal projecting device further includes a distributor 5 coaxially mounted on the driving shaft 3*a* in the inner peripheral space S in the impeller 4 to stir the abrasive particles, a cylindrical control cage 6 mounted on a second sidewall 2*b* which is opposed to the first sidewall 2*a* of the housing 2, to restrict the direction in which the abrasive particles are projected, and a feed cylinder 7, mounted on the second sidewall 2*b* of the housing 2.

The impeller 4 is mounted on the driving shaft 3*a* with a bolt 11 through a hub 10. The impeller 4 comprises a first shroud 12*a* at the side of the driving shaft 3*a* of the driving mechanism 3*a*, a second shroud 12*b* in a position that is spaced apart from the first shroud 12*a* and toward the feed cylinder 7, and further comprises a plurality of blades 13 that are fixedly sandwiched between the first shroud 12*a* and the second shroud 12*b* such that they are arranged radially.

The distributor 5 is fixed to the first shroud 12*a* with a bolt 14. The distributor 5 is provided with openings (cutouts) arranged in its circumference at substantially equal intervals. The number of openings 15 may be equal to, or be more than, or less than, that of the blades 13.

On the control cage 6, a cylindrical portion of its distal end is provided with an equiangular window 17 to restrict the direction in which the abrasive particles are projected. The control cage 6 is mounted on the housing 2 at the side of the second shroud 2*b* such that it extends between the distributor 5 and the blades 13.

Figure 2:
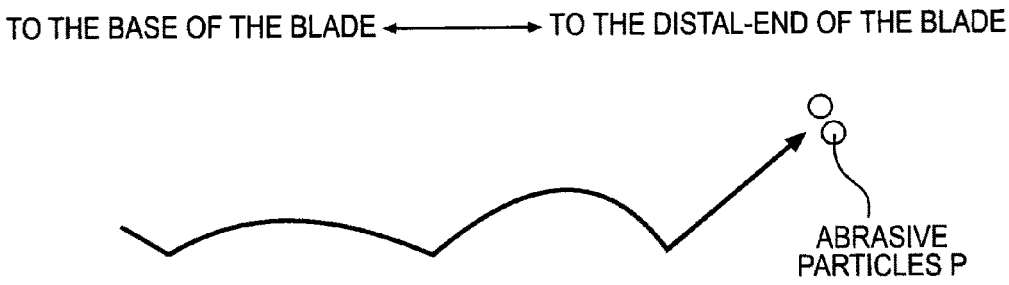
FIG. 2 schematically illustrates the action of an abrasive particle on a blade.
Figure 3:
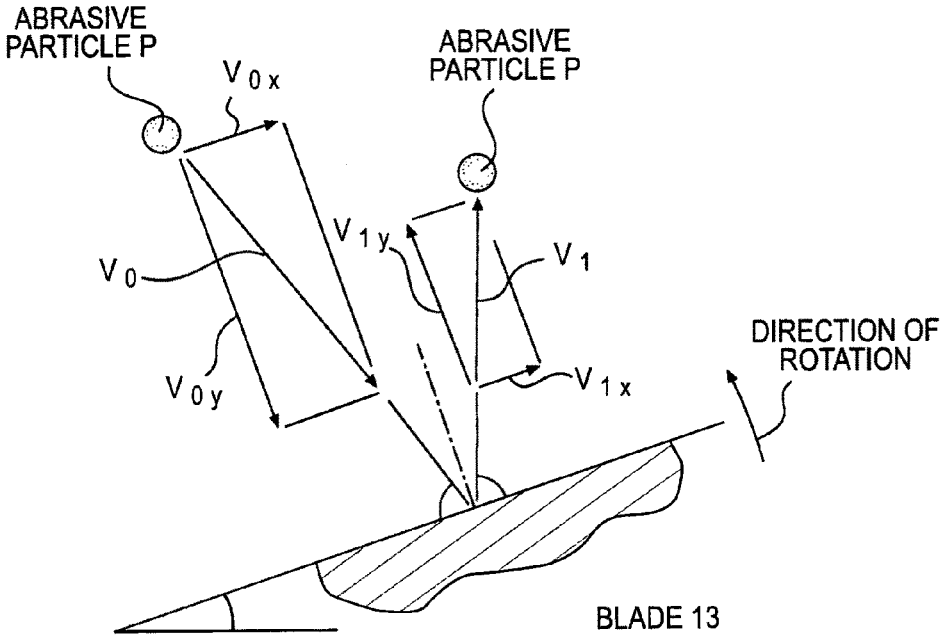
FIG. 3 is a vector diagram that shows velocities of the abrasive particle before and after the collisions with the blades.

FIG. 2 illustrates the action of an abrasive particle P on the blade as a result of the initial experiment. The result of the behavior of the abrasive particle P on the blade can be estimated to be a rebound phenomenon of the blade, rather than a sliding motion on the blade, because pressures are concentrated at two or three positions on the blade. Namely, the abrasive particle P supplied by the feed cylinder of the centrifugal projecting device is stirred by the rotating distributor 5 and is then discharged from the opening 17 of the control cage 6 to the outer periphery of the base of the rotating blade 13. The abrasive particle P is then accelerated and made to rebound on the blade 13 to project the abrasive particle P to the distal end (the outer periphery) of the blade 13.

This means that an analytical model of the distribution of a projection can be expressed using an analytical model of the rebound phenomenon of the abrasive particle P.

Consequently, the vector components of the velocity of the abrasive particle after it has collided are divided into relative velocities (V0*x*, V0*y*, V1*x*, V1*y*) on the X-axis and the Y-axis using a V0 of the abrasive particle P, and a transfer vector V1 of the abrasive particle P from the point of the collision on the surface of the blade.

The vertical component V1*y* may be expressed as a bounce using the coefficient of rebounding. The horizontal component V1*x* may be expressed as a loss of velocity by a resistance caused by friction. Therefore, the following equations (1-1) and (1-2) can be obtained by introducing their respective coefficients.

$$V1y=-e\cdot V_0y \tag{1-1}$$

$$V1x=(1-\mu)\cdot V_0x \tag{1-2}$$

where e is the coefficient of rebounding, and μ is the coefficient of the resistance to friction.

Figure 4:
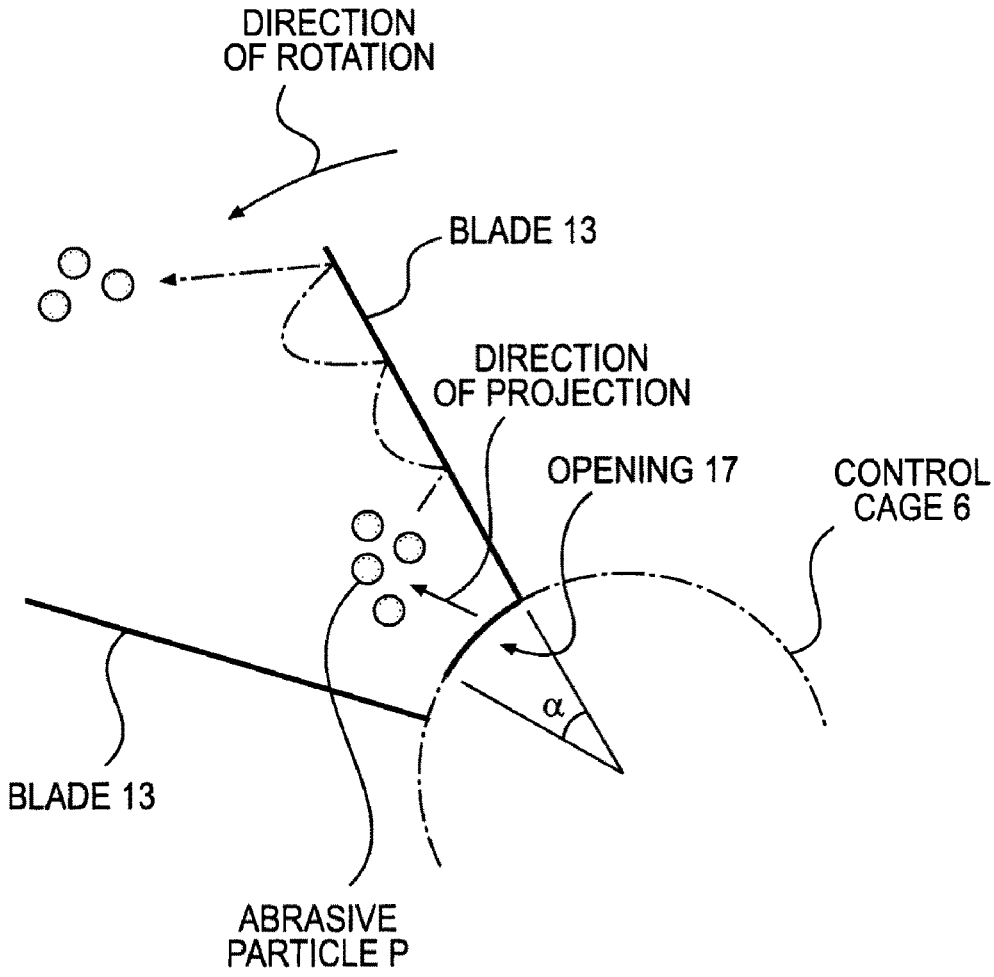
FIG. 4 schematically illustrates factors that contribute to the initial condition in an analytical model.

Initial conditions for the analytical model of the distribution of the projection may include, e.g., information on the dimensions and the rotation of the blade (hereafter, "blade information") that corresponds to various conditions of a real machine, and information on the projection of the abrasive particle from the control cage. For instance, assignable factors, e.g., an outer diameter, an inner diameter, a length, the width of a blade, the number of blades, and a velocity of rotation (velocity of the rotation of an impeller) can be considered in the initial conditions. As shown in FIG. 4, a range (angle α) of the discharge of the abrasive particles P from the opening 17 of the control cage 6, a direction of the projection of the abrasive particles, an initial rate, and the variation of the range of the abrasive particles P, can also be considered in the initial conditions. The range of the discharge corresponds to a range where the abrasive particles P are discharged from the control cage 6. It can be represented as an angle, and determined based on the shape of the opening 17 and the shape of the distributor 5 (not shown in FIG. 4). Further, the range of the variation corresponds to the direction from where the abrasive particles P are projected from the control cage 6 and the range of distribution of the initial rate. Because the range of the distribution varies based on the shape of the opening 17 of the control cage 6 and the shape of the distributor 5, it may be given as a rectangular distribution, in which the degree of probability is constant within the range of the variations, or may be given as the normal distribution by providing a standard deviation as the range of variations. To determine the coefficient of bounce and the coefficient of the resistance to friction for the analytical model, an actual coefficient of bounce is calculated from the result of a measurement of the amount of the bounce of the abrasive particles P on the blade 13 by using actual abrasive particles P and the blade 13. Further, an adequate combination was selected and assigned by collating the result of the measurements of the distribution of the projection and the projection rate by an actual projection examination and the result of a calculation of a distribution of the projection.

Figure 5:
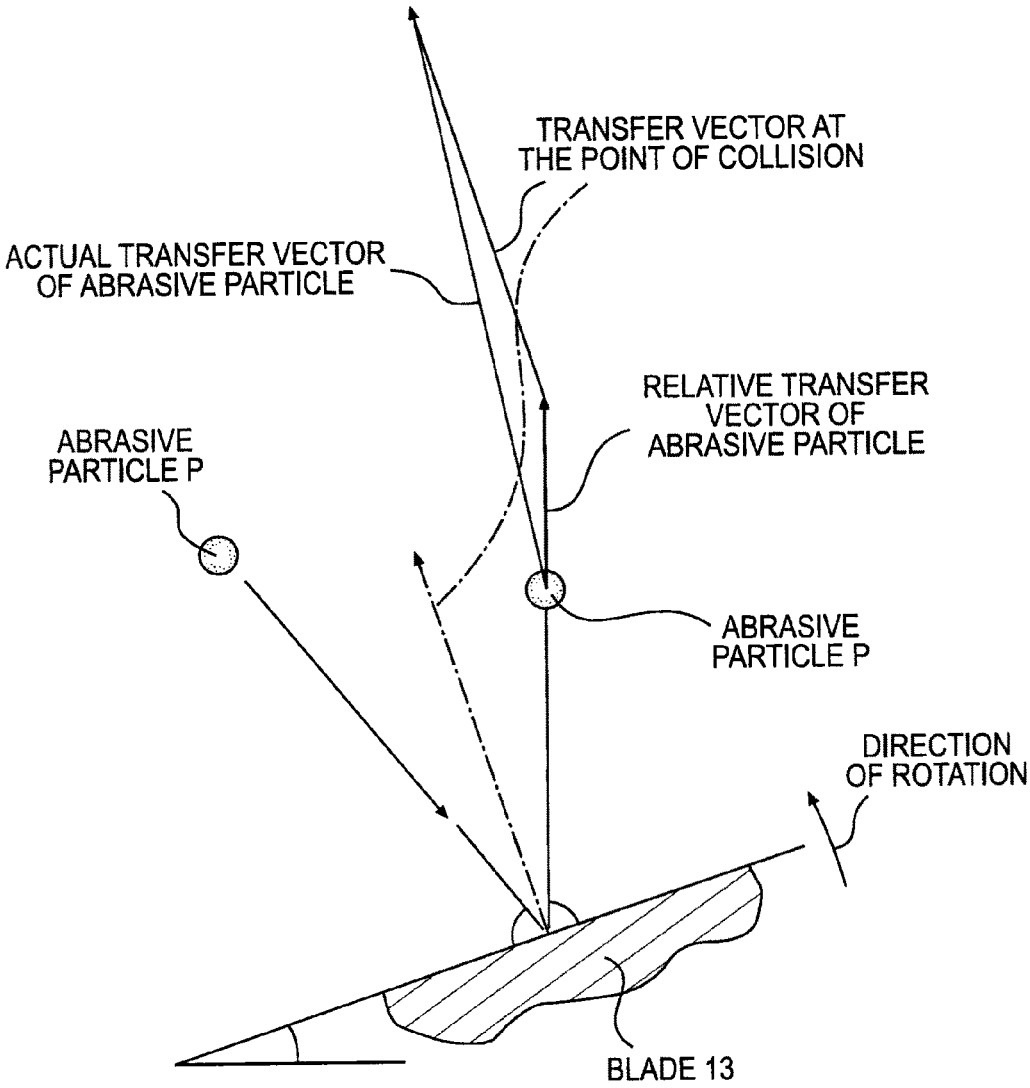
FIG. 5 is a vector diagram that shows the velocity of an abrasive particle after it collides.

In the analytical model, a calculation is carried out for any of the blades 13 that accelerates the abrasive particles under the above initial conditions and the assumption that each blade is symmetrical with respect to a point. Information that comprises the direction of the projection, a position, and a velocity is given to the respective abrasive particles P to calculate a distance for the abrasive particles P and the blade 13 over the time of a sampling, which is preferably 100μ or less, as, say, to consider the accuracy of the calculation. The calculation of the collision of the abrasive particles P that complies with the crash conditions is then carried out sequentially. The positions of the abrasive particles P are thus denoted by polar coordinates (ra, θa). It is estimated that where the angle is θb on the surface, which angle corresponds to a radius diameter ra of the blade, and it is greater than the angle θa for each abrasive particle P, there is a collision. Then the expressions (1-1) and (1-2) in the vertical component and the horizontal component, respectively, which are based on the surface of the blade as a reference, are obtained. As shown in FIG. 5, the resulting transfer vector (actual transfer vector of the abrasive particle) for the abrasive particle on the point of collision on the blade 13 is on the sum of a transfer vector at the point of collision for the blade 13 plus a relative transfer vector for the abrasive particle. The velocity and the direction of the abrasive particle P by the collision with the blade 13 are then recalculated using the above resulting vector (the calculation of the collision is repeated). While not mandatory for the present invention, the results of the analysis after this calculation may be displayed on a touch screen on a system that is equipped with a computer commonly having a calculation function and a display function, or a display screen such as a display on a control panel.

Figure 6:
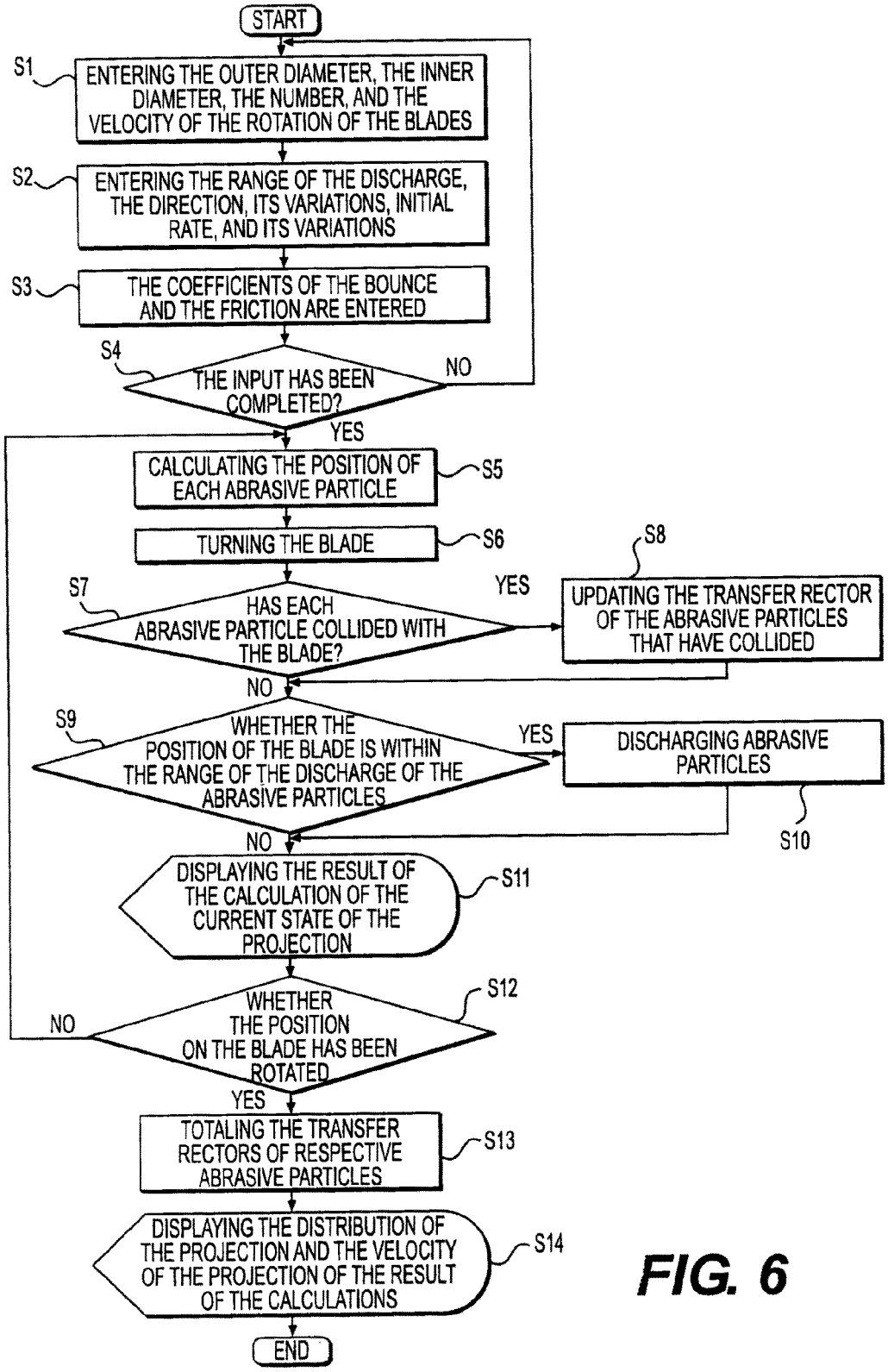
FIG. 6 is a flowchart of one embodiment of the method of the present invention.
Figure 10:
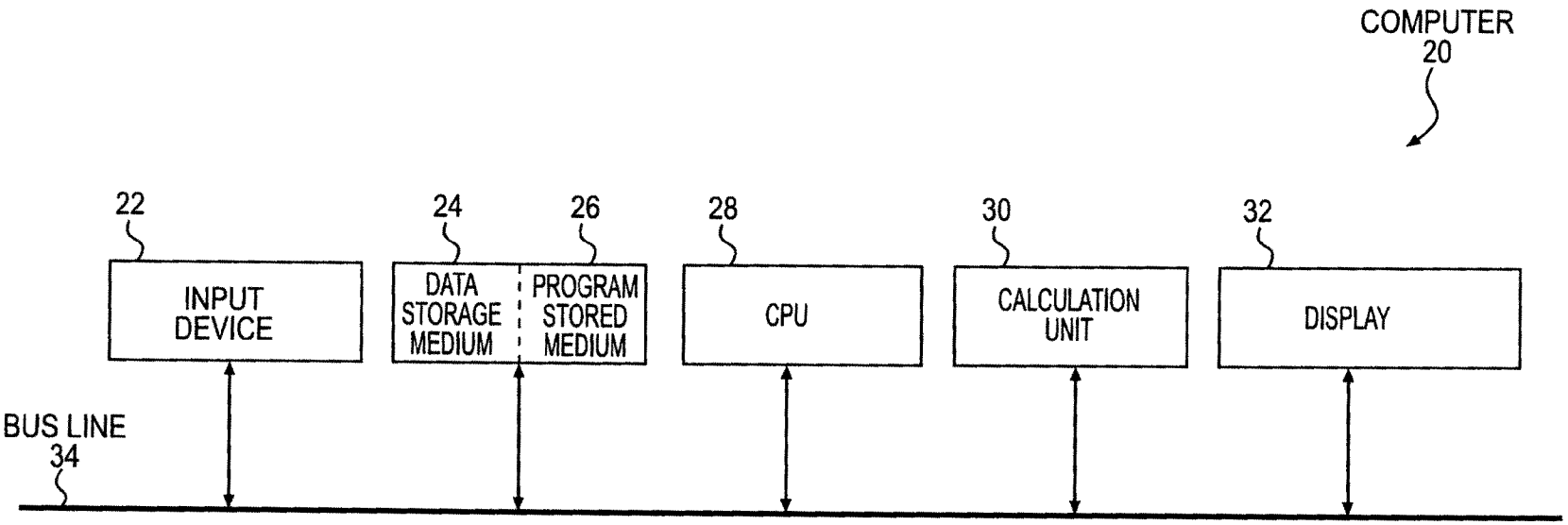
FIG. 10 is a schematic block diagram of one example of a computer used for the system to execute the method of the present invention.

One example of the method of estimating information on the state of a projection of the present invention is shown in the flowchart of FIG. 6. One example of the system that executes the method is schematically illustrated in FIG. 10. A system 20, shown in FIG. 10, is a general-purpose computer in which an input device (input means) 22, which may include a keyboard and mouse, an internal or external data-storing medium 24 for storing data, an internal or external program-storing medium 26 for storing programs, a CPU (estimating means), a calculation unit (calculating means) 30 that includes, e.g., an arithmetic processor associated with the CPU 28, and a display (display means) 32, are all connected by a bus line 34. The display 32 may be a touch screen to be combined with the input device. The programs to execute the method of the present invention, such as a calculating program, etc., to be executed by the calculation unit 30, are stored in the program-stored medium 26.

By referring to the flowchart of FIG. 6, one embodiment to execute the method of estimating information on the state of the present invention with a general-purpose computer 20 will now be explained.

(1) First, data on the outer diameter, the inner diameter, the number, and the velocity of the rotation of the blades 13 are entered into the data storage medium 24 of the computer 20 as the blade information used in the analytical model of the distribution of the projection (step S1). As input values in step S1, say, the outer diameter is 360 mm, the inner diameter is 135 mm, the number of blades 13 is 8, and the rate of the rotation is 3,000 rpm.

(2) The range of the discharge of the abrasive particles P (angle), the direction where the abrasive particles are discharged, the initial rate, and their variations, are then entered in the data storage medium 24 as the information on the discharge from the control cage 6 (step S2). As input values in step S2, for instance, the range of the discharge is 35°, the direction is 90° from the position of the projection to the rotation of the direction, its variation is ±15°, the initial velocity is 10 m/s, and its variation is ±5 m/s.

(3) The coefficient of bounce and the coefficient of the resistance to friction resistance are then temporarily entered in the data storage medium 24 (step S3). As input values in step S3, for instance, the coefficient of bounce is 0.2, and the friction resistance coefficient is 0.6. The inputs in these steps S1, S2, and S3 into the data storage medium 24 of the computer 20 are carried out through the input device 22.

(4) The CPU 28 determines whether the input has been completed (step S4).

(5) If the input is completed in step S4, the calculation unit 30 calculates the position of each abrasive particle per a sampling time 80 μs based on the sampling time and the transfer vector (step S5). Specifically, assuming the position of any abrasive particle at time t is (X, Y), the following distance (Δx, Δy) of the abrasive particle after the sampling time Δt can be obtained as $\Delta x = Vx \times \Delta t$ and $\Delta y = Vy \times \Delta t$ based on the transfer vector (Vx, Vy) of the abrasive particle. Further, the position of the abrasive particle at time t+Δt can be obtained as (X+Δx, Y+Δy).

(6) The CPU28 then turns the blade 13 to update its angle (step S6).

(7) The CPU28 then determines whether each abrasive particle P has collided with the blade 13 (step S7).

(8) If the determination in step S7 has determined that there was a collision, the calculation unit 30 calculates the velocity and the direction of the collided abrasive particle to update the transfer vector (step S8).

Specifically, the position (X,Y) of the abrasive particle is converted to the polar representation (ra, θa). If the angle θb of the surface of the blade 13 that corresponds to the radius ra is greater than the angleθa of the abrasive particle, a collision is considered to have occurred. The above equations (i) and (ii), for the vertical component and the horizontal component, both refer to the surface of the blade as the reference surface. They are then calculated. By summing them and the transfer vector for the blade 13 at the point of collision on the blade, the actual transfer vector for the abrasive particle is then obtained. The velocity and the direction of the abrasive particle P by the collision with the blade 13 are then calculated.

If the determination in step S7 determines that no collision occurred, the transfer vector of the abrasive particle P is not updated.

(9) The CPU28 then determines whether the position of the blade 13 is within the range of the discharge of the abrasive particle P (step S9).

(10) If the position of the blade 13 is within the range of the discharge of the abrasive particle P in step S9, the CPU28 causes the abrasive particles P to be discharged (step S10). The discharge of the abrasive particles P means that the abrasive particles are stirred by the distributor 5 and are discharged from the opening 17 of the control cage 6, and to be discharged into the blade 13 at any time during a process for an article to be processed.

The reason it is necessary to determine whether the position of the blade 13 is within the range of the discharge of the abrasive particle in step S9 is the following: Because, as discussed above, the calculation is carried out for any of the blades 13 that comprise the impeller, it should prevent the abrasive particle P from being discharged when the discharged abrasive particle P is unsuitable for the analysis because of the position of the blade 13 (say, where the rotation of the blade 13 advances such that it passes through the opening 17 of the control cage 6).

Figure 7:
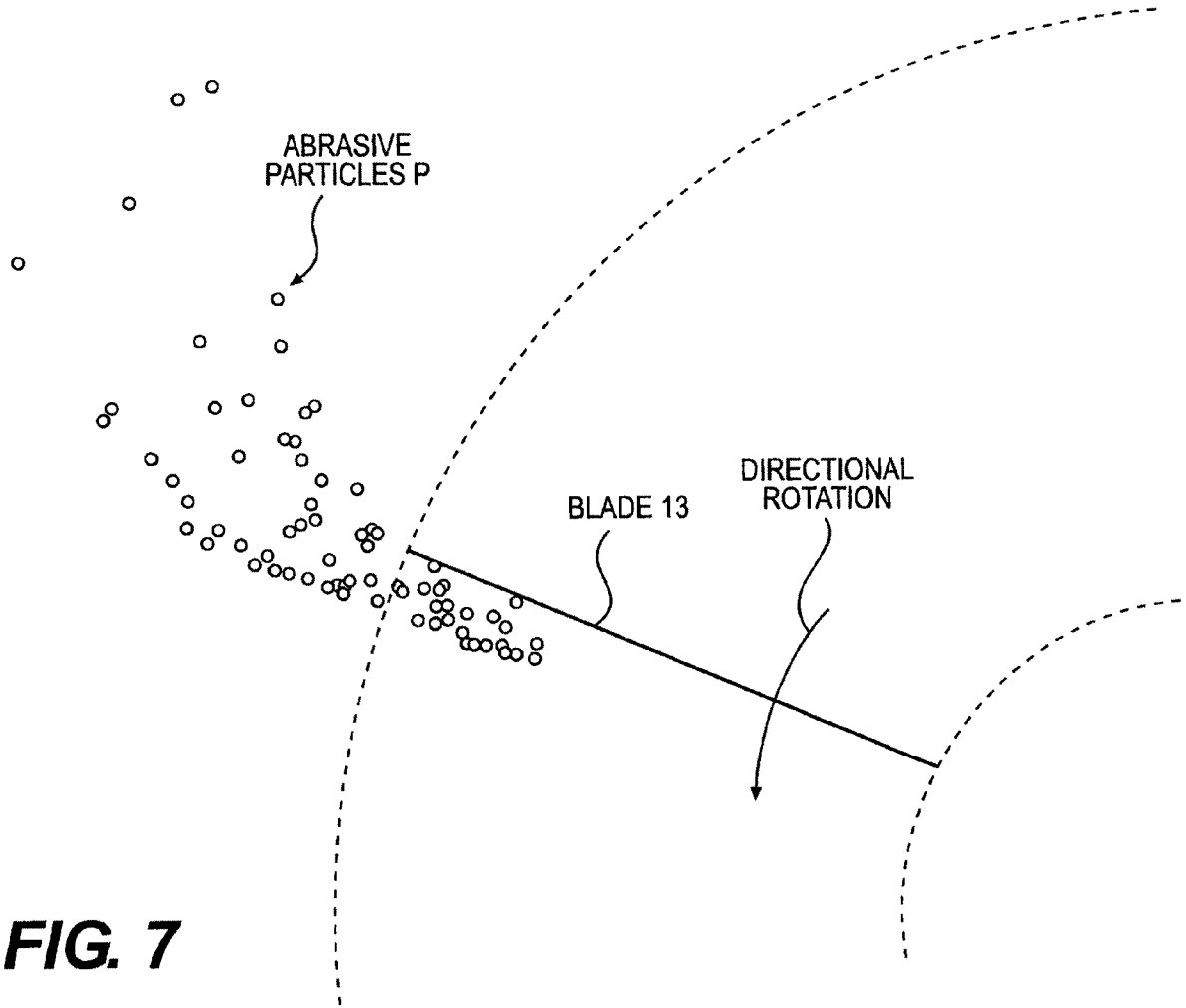
FIG. 7 shows an example of displaying the result of the calculation in the embodiment of FIG. 6.

(11) If the position of the blade 13 is not within the range of the discharge of the abrasive particle P in step S9, the CPU 28 displays the result of the calculation of the current state of the projection on the display 32 (step S11). Typically, 100 to 200 abrasive particles P may be displayed in this step, although it depends on the arithmetical capacity of the computer to be used. FIG. 7 shows an example of the display of the result of this calculation. In this example, the display of the initial condition is omitted.

(12) The CPU 28 determines whether the position of the blade 13 has been rotated to a predetermined position. If not, steps S5 to S12 are repeated to sequentially calculate the positions of the respective abrasive particles, and the angle of the blade and the transfer vector for the abrasive particle, after the following sampling time (step S12).

(13) If the determination in step S12 determines that the position of the blade 13 has been rotated to the predetermined position, the transfer vectors of respective abrasive particles P are totaled (step S13).

(14) The distribution of the projection and the velocity of the projection of the result of the calculations for the total are displayed (step S14).

Figure 8:
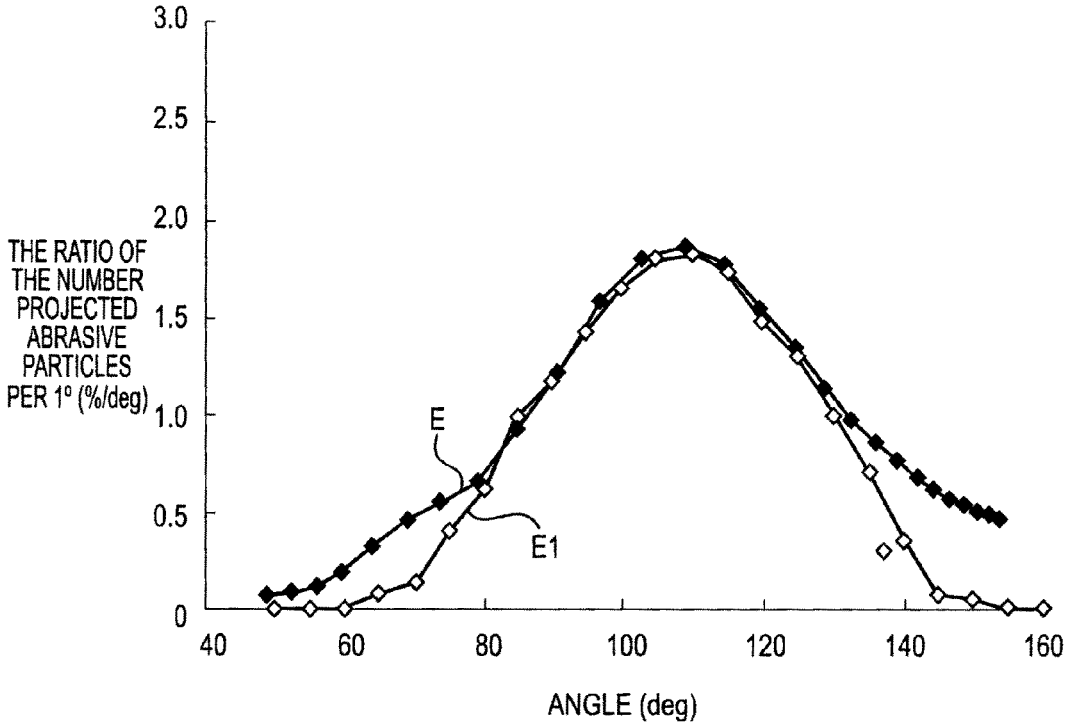
FIG. 8 is a graph of the calculation of the projection E1 of a distribution in conjunction with an actual distribution of the projection E.

It is recognized that the computed distribution of the projection E1 is close to the actual distribution of the projection E, as shown in FIG. 8.

The distribution of the projection and the velocity of the projection of the abrasive particles P from the blade 13 are the following. The distribution of the projection (the ratio of the number of projected abrasive particles per 1°) is one wherein the directions of the transfer vectors of the respective abrasive particles P are described by angles, and are shown by a histogram. The velocity of the projection is the calculated mean values of the lengths of the transfer vectors. The variation in the velocity of the projection is the calculated standard variability.

Figure 9:
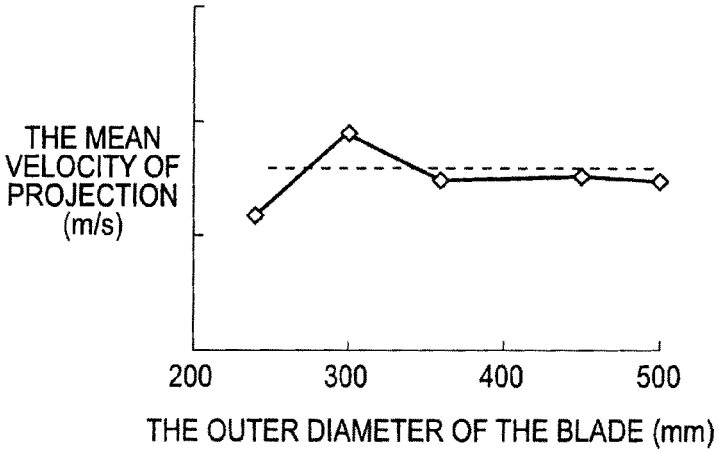
FIG. 9 is a graph of the relationship between the outer diameter and the average velocity of the projection when the velocity of the circumference is constant.

Sequentially, a test is carried out to establish the variation in the velocity of the projection caused by the outer diameter of the blade 13. As shown in FIG. 9, the actual measured values are very close to the calculated values (designated by a broken line).

With this embodiment, the information on the status of the projection, which includes the distribution of the projection, the velocity of the projection, and the variation in the velocity of the projection of the abrasive particles P, can be estimated by using the above model for an analysis of movements. Therefore, the necessary and various design conditions (for instance, the length, the shape, the number, and the rate of the rotation of the blade, and the shape of the opening 17 of the control cage 6) to know information on the predetermined state of the projection, can all be determined by adding any required modification to the initial conditions without actually making them for trial purposes. In the prior art, preproducing the blade and the control cage both meant that the state of the projection had to be repeated by varying their design conditions, to decrease the necessary design conditions to compile the information on the predetermined state of the projection. To the contrary, the cost of the work and the time required to decrease the necessary design conditions can be reduced in the method and the system of the present invention, since neither a blade nor a control cage requires its prototype being manufactured to compile the information of the state of the predetermined projection.

Figure 11:
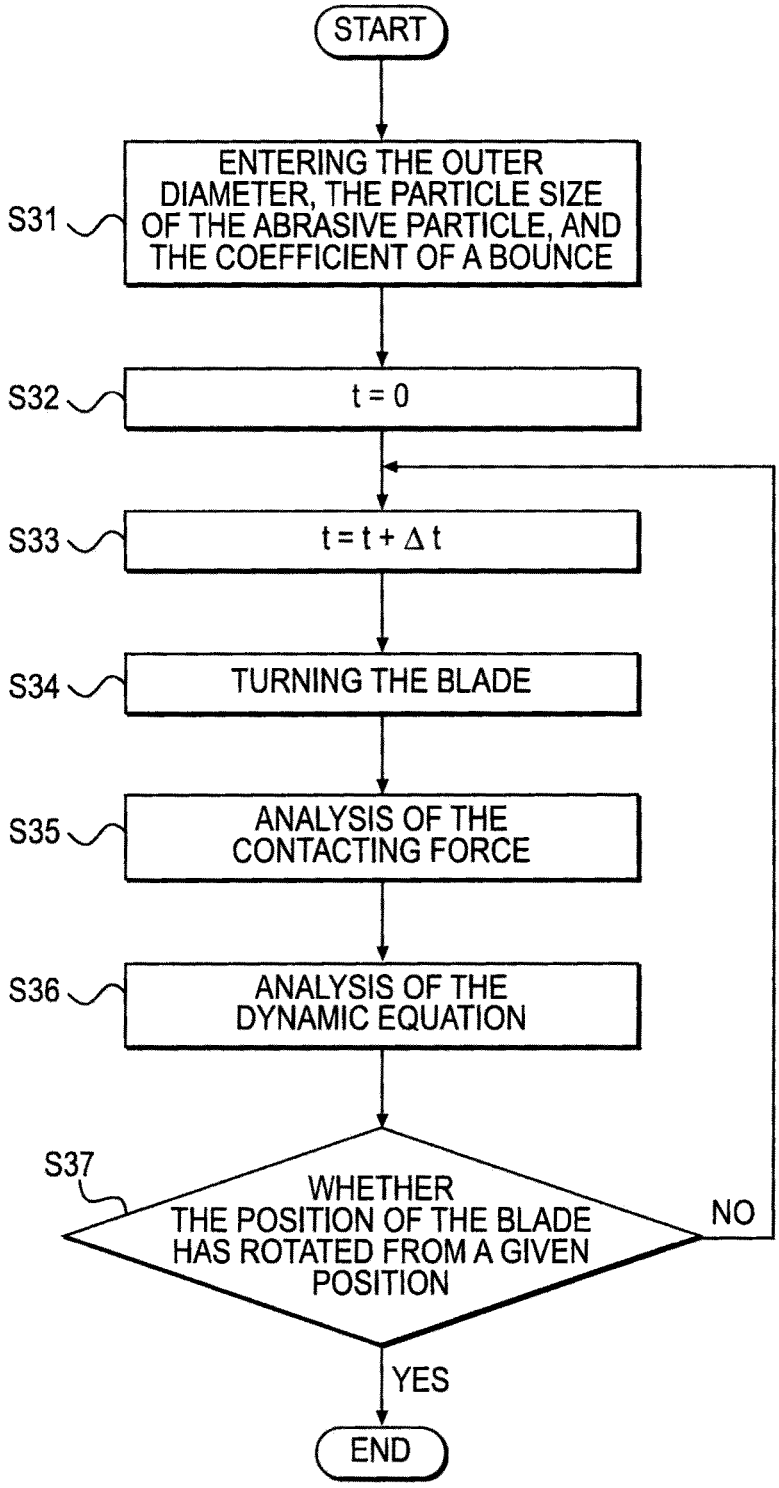
FIG. 11 is a flowchart of another embodiment of the method of the present invention.

By referring to the flowchart of FIG. 11, another embodiment to execute the method for estimating the information on the conditions of the projection of the present invention with the general-purpose computer 20 will be explained.

(1) First, data on the outer diameter, the inner diameter, the number, and the velocity of rotation of the blades 13 are entered in the data storage medium 24 of the computer 20 as the information on the blade for the analytical model of the distribution of the projection. Data on the particle size and the density of the abrasive particle, the amount of the abrasive particles to be discharged, the range of the discharge of the abrasive particles P (angle), the direction where the abrasive particles are discharged, the initial rate, and their variations, are then entered in the data storage medium 24 as the information on the discharge from the control cage 6. Further, a coefficient of bounce and a coefficient of resistance to friction are temporarily entered in the data storage medium 24 (step S31). The inputs in this step S31 into the data storage medium 24 are carried out through the input device 22. As input values for the blade 13 to be entered, for instance, the outer diameter may be 360 mm, the inner diameter may be 135 mm, the number of blades 13 may be 8, and the rate of the rotation may be 3,000 rpm. As input values for the abrasive particle to be entered, the particle size in the diameter may be 1 mm, the density may be 7850 $Kg/m^3$, the amount of the abrasive particles to be discharged may be 200 kg/min, the range of the discharge of the abrasive particles may be 35°, the direction may be 90° from the position of the projection to the rotation of the direction, its variation may be ±15°, the initial velocity may be 10 m/s, and its variation may be ±5 m/s. The coefficient of bounce to be entered may, e.g., be 0.2, and the coefficient of resistance to friction to be entered may, e.g., be 0.6. These input values are just examples, and thus are not to limit the present invention.

(2) The CPU 28 then turns the blade 13 to the following position during a minimal time (for instance, a sampling time $\Delta t$=80 μs after time t=0) (the steps S32, S33, and S34).

(3) The CPU 28 then determines whether each abrasive particle contacts other movable bodies, based on the calculation of the calculation unit 30. If the CPU 28 determines there is a contact, it executes an analysis of the force of the contact acting on each abrasive particle for all the abrasive particles (step S35). The term "other movable body" refers to the blade 13 and other abrasive particles. If the abrasive particle and the other abrasive particle as the other movable body are in contact with each other, the force that acts between these abrasive particles are calculated based on the distance between any abrasive particle i and an abrasive particle j that comes in contact with the abrasive particle i, to determine whether the abrasive particles come in contact. If the abrasive particle i and the abrasive particle j have come in contact, then, based on this result of the determination, a vector that is oriented from the center of the abrasive particle i to the center of the abrasive particle j is defined as the "normal vector," and a vector that is oriented to the direction that is turned 90° clockwise of the normal vector is defined as a "tangent vector."

Figure 12:
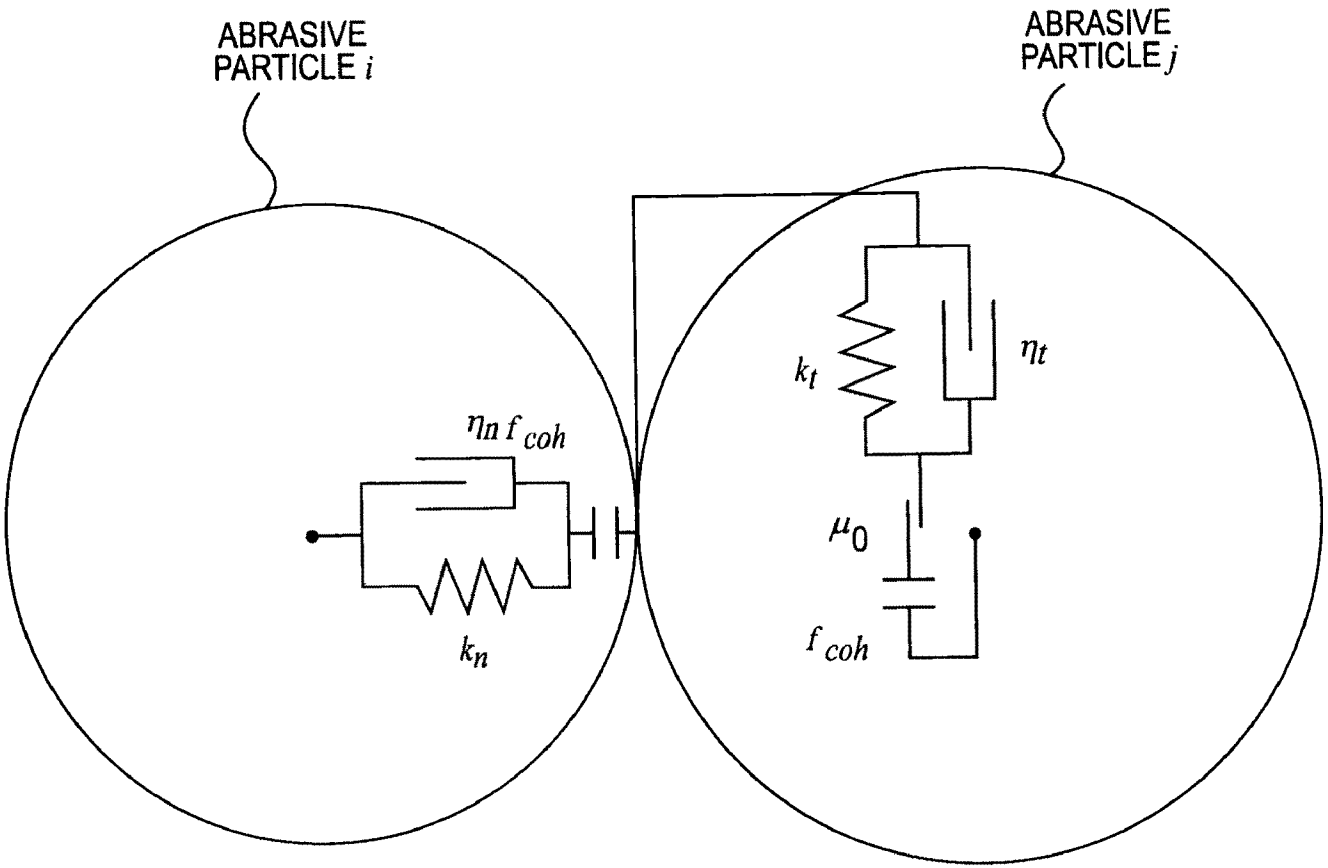
FIG. 12 illustrates one example of finding a force of the contact between the abrasive particles in the model for the analysis of movement.

As shown in FIG. 12, assume virtual and parallel arrangements where each arrangement includes a spring and a dashpot in the normal direction, and where the direction of tangent of the abrasive particles i, j is between the two abrasive particles (discrete elements) i, j that come in contact with each other, to calculate the force of the contact that is exerted from the abrasive particle j to the abrasive particle i. The force of the contact is calculated by the calculation unit 30 as a resultant force resulting from adding the component of the normal direction of the force of the contact to the component of the direction of tangent of the force of the contact.

In step S35, first, the component of the normal direction of the force of the contact is calculated for all abrasive particles. Using an increment of an elasticity resistance, and the spring constant in the elasticity spring proportional to the amount of contact, the relative displacement of the abrasive particle i and the abrasive particle j over a short time can be expressed as $$\Delta e_n = k_n \Delta x_n \quad (1)$$

where $\Delta e_n$: increment of an elasticity resistance, $k_n$: the spring constant in the elasticity spring proportional to the amount of contact, and $\Delta x_n$: the relative displacement of the abrasive particle i and the abrasive particle j over a short time.

The suffix n denotes a component of the normal direction.

Using a coefficient of viscosity of the viscous dashpot proportional to the velocity of the relative displacement, a viscosity resistance coefficient is given by $$\Delta d_n = \eta_n \Delta x_n / \Delta t \quad (2)$$

where $\Delta d_n$: an increment of an elasticity resistance, and $k_n$: the spring constant in the elasticity spring is proportional to the force of contact.

The elasticity resistance and the viscosity resistance that are associated with the component of the normal direction of the force that acts on the abrasive particle i from the abrasive particle j at a given time t can be expressed by equations (3) and (4).

$$[e_n]_t = [e_n]_{t-\Delta t} + \Delta e_n \quad (3)$$

$$[d_n]_t = \Delta d_n \quad (4)$$

where $[e_n]_t$ refers to $e_n$ at the time t.

Therefore, the component of the normal direction of the force of the contact can be expressed by the following equation (5).

$$[f_n]_t = [e_n]_t + [d_n]_t \quad (5)$$

where $[f_n]_t$ is the component of the normal direction of the force of the contact at the time t.

Accordingly, the force of the contact that acts on the abrasive particle i at the time t will be calculated by considering the force of the contact from all abrasive particles.

The component of the direction of tangent of the force of contact of all the abrasive particles is calculated at the end of step S35. It is considered that in the component of the direction of tangent, the elasticity resistance is proportional to a relative displacement and to a velocity of the relative displacement of viscous resistance that is similar to the component of the normal direction, and thus can be calculated by the following equation (6).

$$[f_t]_t = [e_t]_t + [d_t]_t \quad (6)$$

where $f_t$ is the component of the direction of direction of tangent of the force of the contact, $e_t$ is the component of the direction of tangent of the elasticity resistance, and $d_t$ is the component of the direction of tangent of the viscosity resistance.

Because slipping may exist between the abrasive particle i and the abrasive particle j when they come into contact, Coulomb's law concerning slipping is used.

Normally, where the component of the direction of tangent is greater than the component of the normal direction, the following occurs:

$$[e_t]_t = (\mu_0 [e_n]_t + f_{coh}) \cdot \mathrm{sign}([e_t]_t) \quad (7)$$

$$[d_t]_t = 0 \quad (8)$$

That is, it is the case where the component of the normal is greater than the component of the component of the direction of the tangent.

$$[e_t]_t = [e_t]_{t-\Delta t} + \Delta e_t \quad (9)$$

$$[d_t]_t = \Delta d_t \quad (10)$$

In equations (7) to (10), μ0 is the coefficient of friction, $f_{ech}$ is the power of adhesion, and sign (Z) refers to positive and negative signs of the variable Z.

Because the abrasive particles to be used in this embodiment are dry, the power of adhesion between the abrasive particles may be disregarded.

(4) In step S36, the analysis of the motion equation is executed to obtain the acceleration expressed by the following equation (11) based on forces that act on the abrasive particles i and j, which include a force of the contact and gravity. Further, in this step a similar analysis is executed for all the abrasive particles, $$\ddot{r} = \frac{f_c}{m_c} + g \quad (11)$$

where r is the position vector, mc is the mass of the abrasive particle (it may be obtained by the size and the density in the initial conditions), fc is the force of the contact, and g is the acceleration caused by gravity.

Further, a gyration is caused by the angle of the collision when there is a state of contact. The angular acceleration of it is calculated by the following equation.

$$\dot{\omega} = \frac{T_c}{I} \quad (12)$$

where ω is an angular acceleration, Tc is a torque caused by the contact, and i is an inertia moment.

Figure 13:
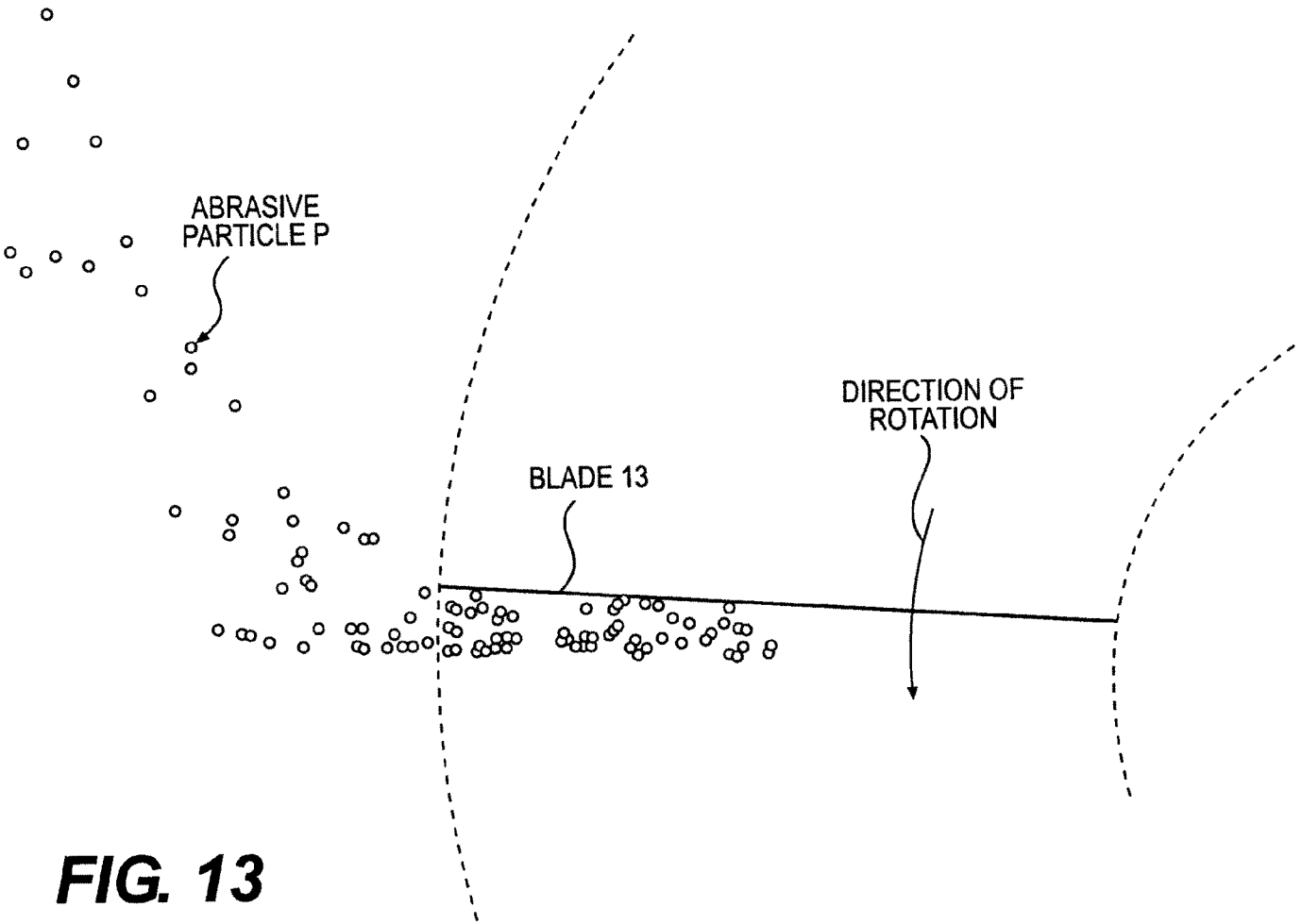
FIG. 13 shows an example of displaying the result of the calculation in the embodiment of FIG. 12.

The following velocity and the position are obtained after a short time by the following equations (13), (14), and (15) based on the acceleration that has been obtained by equation (11). $V_0$ and $r_0$ are the transfer vectors and the position vectors at present. FIG. 13 shows an example of the display of the result of this calculation.

$$v = v_0 + \ddot{r}\Delta t \quad (13)$$

$$r = r_0 + v_0 \Delta t + \frac{1}{2}\ddot{r}\Delta t^2 \quad (14)$$

$$\omega = \omega_0 + \dot{\omega}\Delta t \quad (15)$$

where v is a transfer vector, and Δt is a short time.

(5) Then a determination whether the position of the blade 13 has rotated from a given position, e.g., the starting position in the embodiment, to 270°, is executed (step S37). If not, steps S34 to S37 are repeated to calculate the angle of the blade, the force of the contact that acts on the abrasive particles, and the motion equation obtained after a short time. The calculation is ended when a determination that the blade turns to a predetermined position is obtained.

(6) The distribution of the projection with the total and the result of the calculation of the velocity of the projection are displayed. It was found that the calculation on the distribution of the projection E1 was close to the real distribution of the projection E, as the results are similar to those in FIG. 8 in the first embodiment, The definitions of the distribution of the projection and the velocity of the projection from the blade are the following. The distribution of the projection is described by the histogram of the direction of the transfer vector of each abrasive particle that is described by the angle. The velocity of the projection is obtained by calculating the mean value of the size of the transfer vector. The variations of the velocity of the projection are obtained by calculating the standard deviations.

Sequentially, a test is carried out to see the variation in the velocity of the projection caused by the outer diameter of the blade. In the result of a test similar to that shown in FIG. 9, the actual measurement values were very close to the calculated values (designated by a broken line).

This embodiment describes the case where the other movable objects that should come in contact with each abrasive particle are other abrasive particles. With the model of analysis of the movement of the present invention, however, the distribution of the projection and the velocity of the projection can also be similarly calculated where each abrasive particle should come in contact with the blade. In this case, the analysis of the movement of the abrasive particle can be executed by applying similar steps by replacing the other movable body that should come in contact with each abrasive particle in the above method with the blade. Further, the distribution of the projection and the velocity of the projection can be calculated by using the analytical model of the movement in consideration of both the contact of each abrasive particle with other abrasive particles and contact with the blade.

As another embodiment of the present invention, to be described is a method for adjusting the distribution of the projection of the abrasive particle to a predetermined profile. To numerically express the level of the diffusion of the distribution of the projection, the direction where each abrasive particle disperses is indicated by an angle. The standard deviation in the angles of the abrasive particles is estimated to be a variability of the direction of the abrasive particles.

In this embodiment, the profile of the distribution of the projection of the abrasive particles can be adjusted such that the variability of the frequency to which each discharged abrasive particle rebounds on blade 13 may come below a predetermined value. To this end, the size of the blade 13, the range of the positions from which the abrasive particles are distributed at the opening to discharge the abrasive particles, and the rate of the rotation of the blade 13, are configured or combined. This adjustment in the profile of the distribution of the projection of the abrasive particles can also be carried out by using the analytical model of the collision of the abrasive particle and the rotating blade 13 discussed above.

Figure 14:
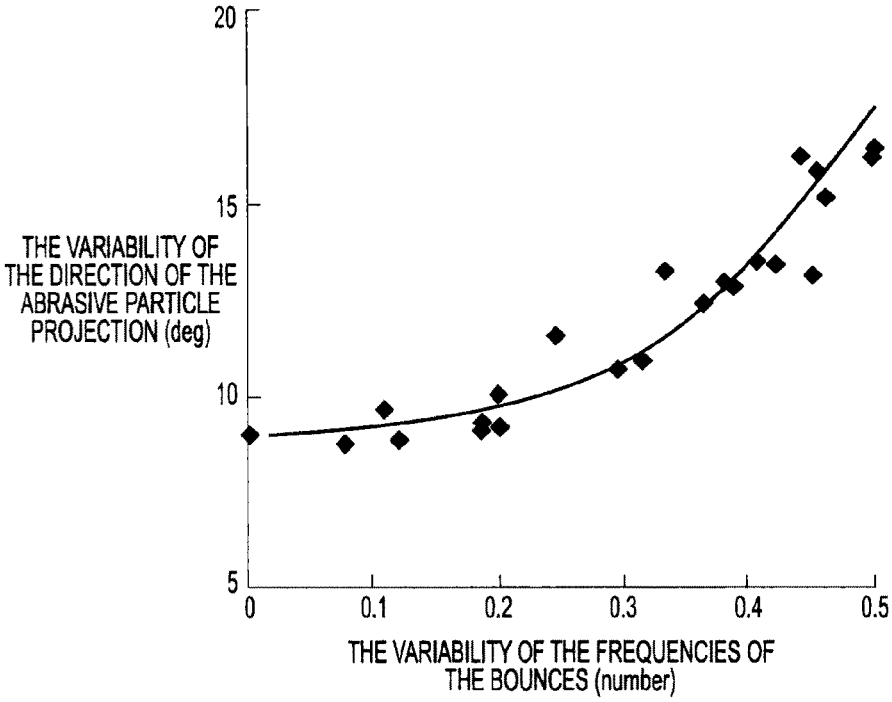
FIG. 14 is a graph of the relationship between variability of the frequency of the rebounding of the abrasive particle and a variability of a direction of the projection of the abrasive particle.

FIG. 14 shows the relationship between the variability of the frequencies of the bounces of each abrasive particle and the variability of the direction of the abrasive particle projection. In this relationship, the variability of the frequencies of the bounces of each abrasive particle refers to the standard deviation of the frequencies of the bounces of each abrasive particle. As will be appreciated from FIG. 14, the variability of the direction of the abrasive particle projection increases as the variability of the frequencies of the rebounding is increased. That is, the angle of the projection in the direction of the projection of the particle diffuses. Therefore, the angle of the projection can be concentrated by adjusting the variability of the frequency of the bounces to a predetermined value, for instance, 0.3 or less.

Figure 15:
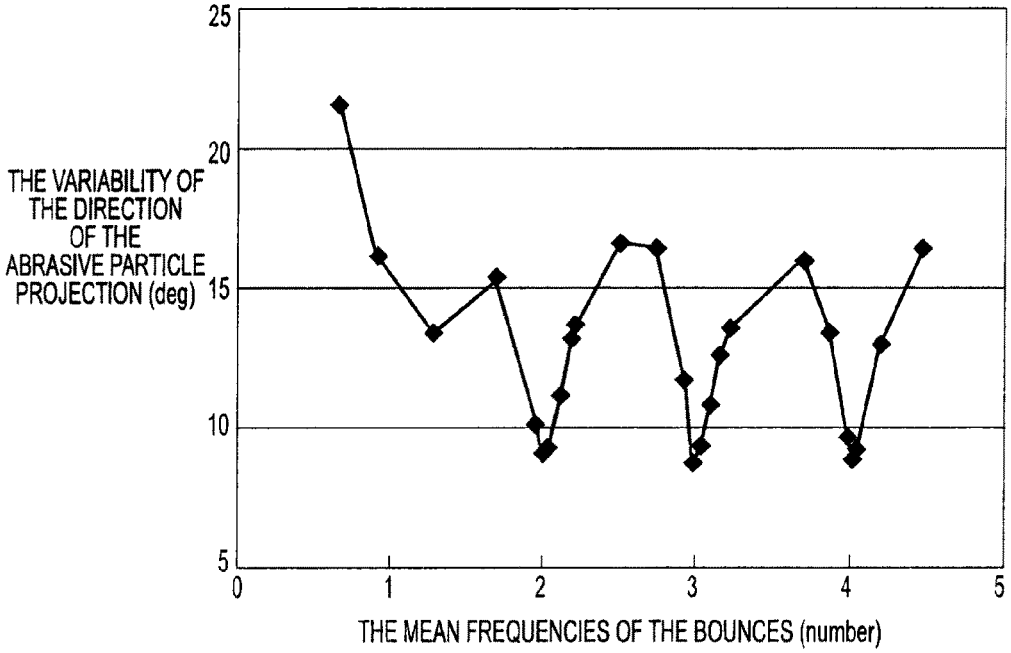
FIG. 15 is a graph of the relationship between a mean frequency of the rebounding of the abrasive particle and a variability of a direction of the projection of the abrasive particle.

FIG. 15 shows a relationship between the mean value of the frequency of the bounces and the variability of the direction of the abrasive particle projection. If the mean value of the frequency of the bounces is less than double, the variability of the abrasive particle discharge position from the control cage 6 causes the projection angle to be diffused readily, and then the abrasive particles cannot be accelerated with stability. Consequently, a variability is caused in the velocity of the projection. Therefore, it is preferable that the mean value of the frequency of the bounces be double or more. To change the variability of the frequency of the bounces and the mean value of the frequency of the bounces, the outer diameter, the inner diameter, and the rotational velocity of the blade 13 were changed in the calculations.

The frequency of splashing greatly affects the factor by which the distribution of the projection and the velocity are to be decided. Because the individual abrasive particle splashes several times on the blade 13, the direction of the projection is turned in the direction of the rotation of the blade 13 in many splashes. Thus an acceleration by the collision may be obtained. In contrast, a small number of splashes, the direction of projection is turned to the opposite direction to the direction of rotation of the blade 13, and thus the resulting acceleration is insufficient. Accordingly, combining different frequencies of the number of splashes of the abrasives causes the differences in directions of the abrasive particle projection for the respective abrasive particles, and thus the distribution of the projection may spread. Therefore, the distribution of the projection of the abrasive particles can be concentrated by controlling the variability of the frequency that an individual abrasive particle splashes on the blade 13 to be a predetermined value or less. On the other hand, difference number of splashing frequencies to exceed the predetermined value causes the distribution of the projection of the abrasive particle to spread.

Figure 16:
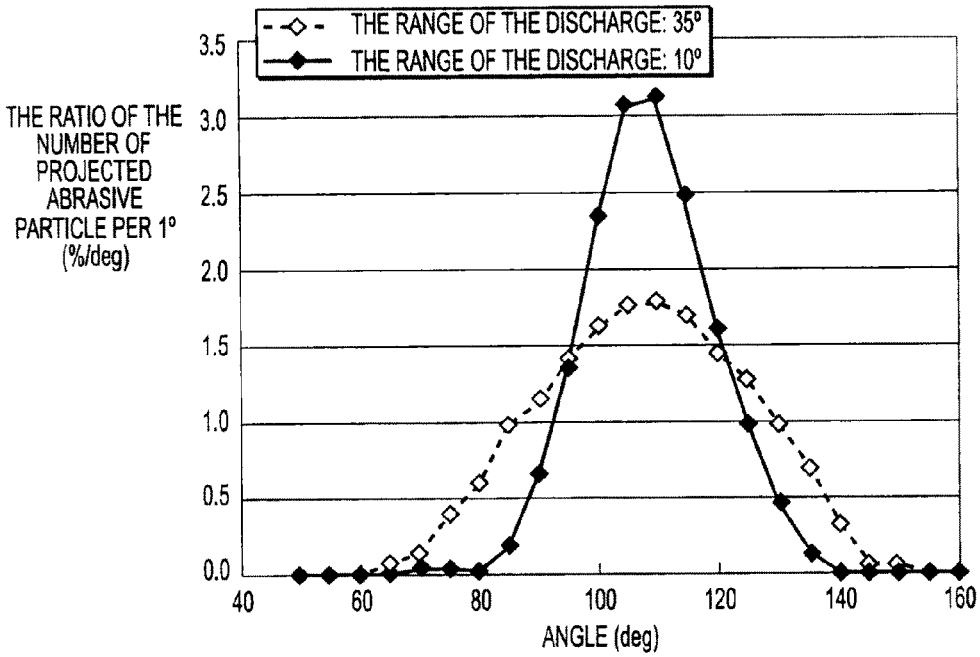
FIG. 16 is a graph of the distribution of the projections shown by different ranges of the positions from which the abrasive particles are discharged.

FIG. 16 shows the result of the analysis of the distribution of the projection for a projection experiment under a range (a range of the discharge) where the abrasive particle discharge position from the control cage 6 is to be 35° and 10°. As conditions used for this experiment, the blade 13 has an outer diameter of 360 mm and an inner diameter of 135 mm, and a rotational velocity was set to 3000 rpm. As a result, the distribution of the projection was concentrated by the range of the abrasive particle discharge position being narrow.

Figure 17:
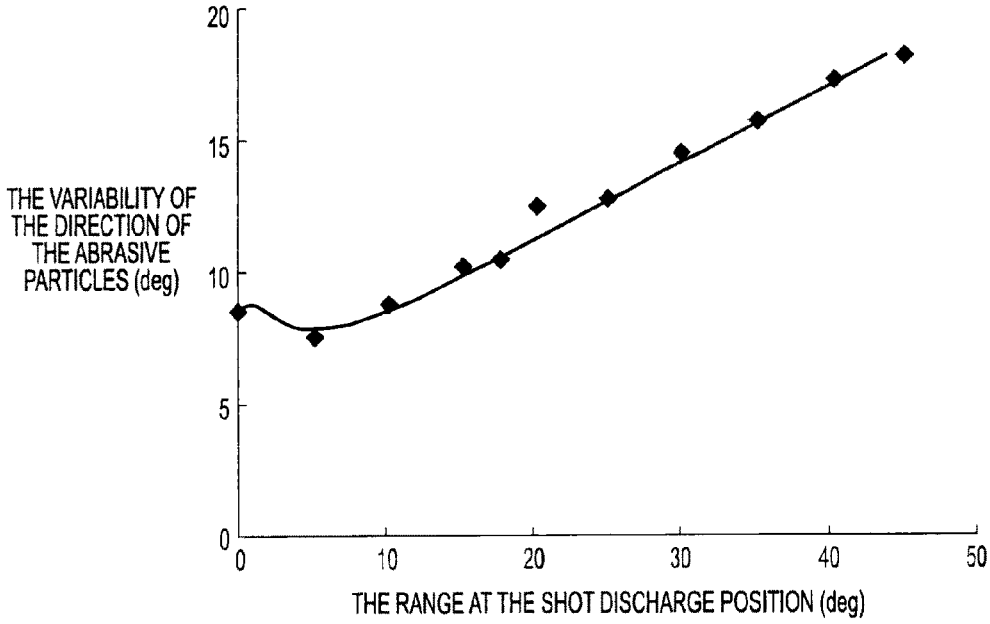
FIG. 17 is a graph of the variability of a direction of the projection of an abrasive particle projection while the ranges of the positions from which the abrasive particles are discharged are varied.

FIG. 17 shows the variability of the direction of the abrasive particle projection when the range at the abrasive particle discharge position is changed, under the conditions similar to those in the experiment of FIG. 16, to see the effect of that range. FIG. 17 indicates that the variability of the direction of the projection of the abrasive particle becomes small, and narrows the range at the abrasive particle discharge position. However, if the range at the abrasive particle discharge position is narrowed too much, the resistance of the opening 17 of the control cage 6 is increased. This causes problems of decreasing the possible maximum projection of the centrifugal projection machine and keeping the abrasive particle in the control cage 6 during the operation. Preferably, the range at the abrasive particle discharge position is to be 5° to 20°, to avoid such problems. It was experimentally found that this range is preferable, regardless of the conditions, i.e., the outer diameter, the inner diameter, or the velocity of the rotation of the blade 13, to be used.

Figure 18:
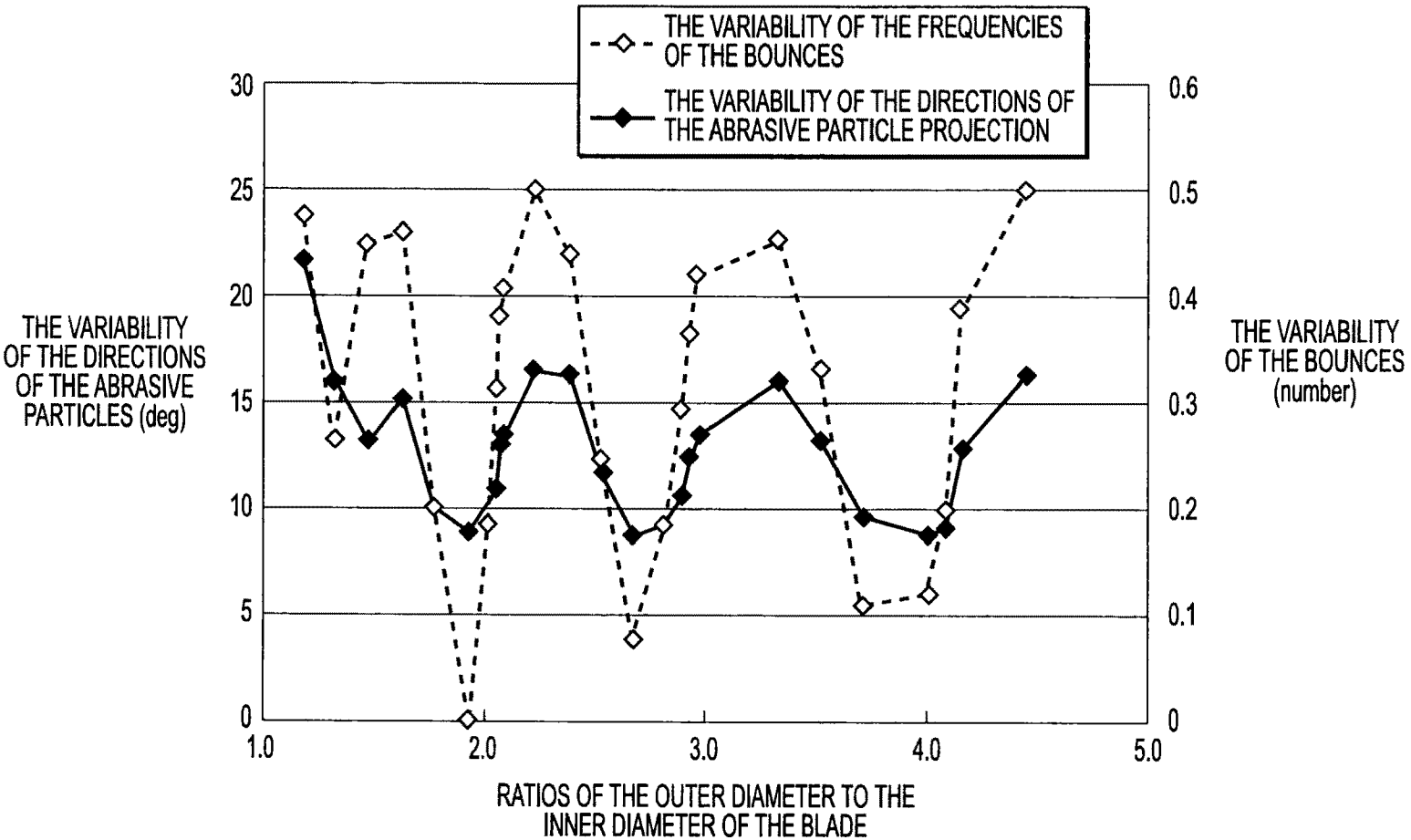
FIG. 18 is a graph of the relationship between the proportion of the outer diameter relative to the inner diameter, a variability of a frequency of the rebounding of the abrasive particle, and a variability of a direction of the projection of the abrasive particle.

FIG. 18 shows the relationships between ratios of the outer diameter to the inner diameter of the blade 13 and the variability of the direction of the projection of the abrasive particles and of the frequencies of the rebounding of the abrasive particles. By varying the ratio of the outer diameter to the inner diameter of the blade 13, the variability of the frequency of the rebounding is significantly varied, and thus the variability of the projection direction of the abrasive particles is also varied. Therefore, the distribution of the projection can be concentrated by setting the inner diameter and the outer diameter of the blade 13 to a predetermined ratio. That is, the variability of the frequency of the rebounding of the abrasive particles becomes 0.3 or less by setting the ratio of the inner diameter and the outer diameter of the blade 13 to any of the ranges of 1:1.75 to 1:2.0, 1:2.5 to 1:2.9, or 1:3.6 to 1:4.1. Because these ranges cause that mean value n of the frequency of the rebounding to become close to the integer, the variability of the frequency of the rebounding of the abrasive particles is decreased. The mean value n of the frequency of the rebounding corresponding to these ranges is near 2, 3, and 4. This is the same as the case where the range of the ratio of the inner diameter and the outer diameter of the blade 13 is close to the integer of n=5 or more, although the range corresponding to n=5 or more is not specified herein in consideration of the size of the blade actually used. The distribution of the projection can be diffused by setting the ratio of the inner diameter and the outer diameter of the blade 13 to be outside these ranges.

As the conditions of the experiment in this embodiment, the rate of rotation is 3000 rpm, the range of the abrasive particle discharge position is 10°, while the outer diameter and the inner diameter of the blade 13 are varied. Preferably, the rate of rotation is 2500 rpm or more. If the rate of rotation is less than 2500 rpm, the acceleration of the abrasive particles is insufficient, and the influence of the initial velocity of the abrasive particles causes the distance for the abrasive particles until they collide with the blade 13 to be increased such that the positions of the abrasive particles are significantly varied. Therefore, the abrasive particles may be readily distributed on the blade 13. Thus the variability of the direction of the projection of the abrasive particle is also increased. Similar to them, the range of the abrasive particle discharge position is preferably 5° to 20°.

The respective embodiments just intend to illustrate the present invention, and are not intended to limit the present invention. For instance, the projection machine on which the present invention can be applied is not limited to the centrifugal projection machine as shown in the embodiments. The present invention can also be applied to a projection machine that includes a rotary plate that rotates by means of a driving motor, a plurality of blades mounted on the rotary plate, and a supply line having an outlet from which abrasive particles are fed to the blades.

As the information on the state of projection of the abrasive particles, although both the distribution of the projection and the velocity of the projection are obtained in the above embodiments, just either one of them may be obtained, if desired.

The invention claimed is:

1. A method of estimating information on a state of projection of abrasive particles projected by a centrifugal projection machine that includes a plurality of blades that rotate at a high rate, the method comprising the steps of:

analyzing, using a computer, a behavior of abrasive particles projected by said centrifugal projection machine on said blades to create an analytical model; and estimating, using the computer, the information on the state of the projection of the abrasive particles projected by said centrifugal projection machine using said analytical model.

2. The method of claim 1, wherein said behavior of each of said abrasive particles includes contact with at least one of other abrasive particles and one of the rotating blades.

3. The method of claim 1, wherein the information on the state of the projection of the abrasive particles is at least one of a distribution of a projection of said abrasive particles and a velocity of a projection of the abrasive particles.

4. A method of estimating information on a state of projection of abrasive particles projected by a centrifugal projection machine that includes a plurality of blades that rotate at a high rate, and an opening through which the abrasive particles are projected by said blades to an article to be processed, the method comprising the steps of:

determining, using a computer, initial conditions that include information on a size and a rate of rotation of said blades of said centrifugal projection machine, information on the projection of the abrasive particles, and information on the abrasive particles in relation to said blades;

storing said initial conditions in the computer's memory;

calculating, using the computer, a position of each abrasive particle, and velocities and directions of the abrasive particles after collisions with said blades, based on said initial conditions; and estimating, using the computer, the information on said state of the projection based on results of said calculating step.

5. The method of claim 4, wherein the information on the state of the projection of the abrasive particles is at least one of a distribution of a projection of said abrasive particles and a velocity of a projection of the abrasive particles.

6. The method of claim 4, wherein said calculating step includes:

expressing a velocity of each abrasive particle after a collision as a relative velocity that includes a vertical component along a Y-axis and a horizontal component along an X-axis using a transfer vector of the abrasive particle and a transfer vector of a movement of a point of collision on a surface of a corresponding blade on which the abrasive particle is impacted, wherein the vertical component of the relative velocity is expressed as a bounce using a coefficient of bounce by a determination of the coefficient of bounce, and wherein the horizontal component is expressed as a loss of speed due to a resistance to friction by a determination of a coefficient of resistance to friction; and calculating a velocity and a direction of the abrasive particle after a collision with the corresponding blade by summing the velocity, the direction and the transfer vector of the movement of the point of collision on the surface of the corresponding blade.

7. The method of claim 4, wherein said calculating step includes:

calculating a magnitude of a force of contact of each abrasive particle relative to a corresponding blade on which the abrasive particle is impacted and relative to another abrasive particle; and calculating an acceleration of the abrasive particle based on forces that act on the abrasive particle that include said force of the contact and gravity, and obtaining data on a velocity and a position of the abrasive particle after a minimal time based on the calculated acceleration.

8. The method of claim 4, wherein said calculating step calculates a distance that the abrasive particle moves and a distance that a corresponding blade moves in a sampling time, and executes the calculation relating to a collision of the abrasive particle based on sequential conditions for collisions.

9. The method of claim 4, wherein the method further includes the step of displaying results of said calculating step.

10. The method of claim 4, wherein the method further includes the step of adjusting a profile of a distribution of the projection of the abrasive particles to a predetermined profile by selecting values of dimensions of each blade, a range of positions of projection on the opening from which the abrasive particles are projected, and a rate of rotation of the blade such that a variability of a frequency at which each discharged abrasive particle rebounds from the blade is a predetermined value or less.

11. The method of claim 10, wherein the predetermined value is 0.3.

12. The method of claim 10, wherein the range of positions for the projection on the opening from which the abrasive particles are projected is 5° to 20°.

13. The method of claim 10, wherein the values of the dimensions include a ratio of an inner diameter and an outer diameter of the blade, wherein a range of this ratio is any one of 1.75 to 2.0, 2.5 to 2.9, and 3.6 to 4.1.

14. A system with a programmed computer for estimating information on a state of projection of abrasive particles projected by a centrifugal projection machine that includes a plurality of blades that rotate at a high rate, said computer comprising:

a) input means for providing initial conditions that include information on a size and rotation of said blades, information on the projection of the abrasive particles, information on the abrasive particles in relation to said blades and to said computer;

b) calculating means for calculating a position of each abrasive particle, and velocities and directions of the abrasive particles after collisions with said blades, based on said initial conditions;

c) means for estimating the information on said state of the projection based on results of said calculation; and d) means for displaying the calculated results and the estimated information.

15. The system of claim 14, wherein said calculating means calculates a magnitude of a force of a contact of each abrasive particle relative to at least one of the blades and other abrasive particles, and calculates an acceleration of the abrasive particle based on forces that act on the abrasive particle that include said force of the contact and gravity, and obtains a velocity and a position of the abrasive particle after a minimal time based on the calculated acceleration.

16. The system of claim 14, wherein said computer further includes a storage medium in which a program for a calculation to be executed by said calculation means is stored.

17. The system of claim 14, wherein said calculating means expresses a velocity of each abrasive particle after a collision as a relative velocity that includes a vertical component along a Y-axis and a horizontal component along an X-axis using a transfer vector of the abrasive particle and a transfer vector of a point of collision on a surface of a corresponding blade on which the abrasive particle impacts, wherein the vertical component of the relative velocity is expressed as a bounce using a coefficient of bounce by a determination of the coefficient of bounce, and wherein the horizontal component is expressed as a loss of speed caused by a resistance to friction by a determination of a coefficient of resistance to friction; and wherein said calculating means calculates a velocity and a direction of the abrasive particle after a collision with the corresponding blade by summing the velocity, the direction and the transfer vector of the point of collision on the surface of the corresponding blade.

18. The system of claim 14, wherein said calculating means calculates a distance a abrasive particle moves and a distance a corresponding blade moves in a sampling time, and executes the calculation relating to a collision for an abrasive particle based on sequential crash conditions.

19. The system of claim 14, wherein a profile of the distribution of the projection of the abrasive particles is adjusted to a predetermined profile by selecting values of dimensions of each blade, a range of positions of projection on an opening from which the abrasive particles are projected, and a rate of rotation of the blade such that a variability of a frequency at which each discharged abrasive particle rebounds for the blade is a predetermined value or less.

20. The system of claim 19, wherein the predetermined value is 0.3.

21. The system of claim 19, wherein the range of positions of the projection on the opening from which the abrasive particles are projected is 5° to 20°.

22. The system of claim 19, wherein the values of the dimensions include a ratio of an inner diameter to an outer diameter of the blade, wherein a range of this ratio is any one of 1.75 to 2.0, 2.5 to 2.9, and 3.6 to 4.1.

23. A method aided by a programmed computer for controlling a projection of abrasive particles to be projected to an article by a projection machine that includes a plurality of blades that rotate at a high rate, and for estimating information on the state of said projection of the abrasive particles, the method comprising the steps of:

a) entering information on the blade, a condition of projection of abrasive particles, and a coefficient of bounce and a coefficient of resistance to friction of the abrasive particles, in said computer;

b) determining by said computer whether said entering in said entering step is completed, and calculating by said computer positions of respective abrasive particles per a given sampling time based on the sampling time and a transfer vector of the abrasive particles, if said entering is completed;

c) turning the blades by said computer to update the angles of the blades;

d) determining by said computer whether each abrasive particle impacts a corresponding blade, calculating by said computer a velocity and a direction of the impacted abrasive particle to update the transfer vector of the abrasive particle, if said computer determines that the abrasive particle impacts the corresponding blade, and maintaining the transfer vector, if said computer determines no abrasive particle impacts the corresponding blade;

e) determining by said computer whether a position of said blades is within a range from which the abrasive particles are discharged, discharging the abrasive particles, if the position of said blades is within the range of discharge of the abrasive particles, and preventing the abrasive particles from being discharged, if the position of said blades is outside the range of discharge of the abrasive particles, f) determining by said computer whether the positions of the blades have been turned to the predetermined positions, totaling the transfer vectors of respective abrasive particles, if said determination indicates that the positions of the blades have been turned to the predetermined positions, and repeating steps b) to f), if said determination indicates that the positions of the blades has not been turned to the predetermined positions; and g) displaying by said computer the distribution of the projection and the velocity of the projection and results of calculations.

* * * * *

UNITED STATES PATENT AND TRADEMARK OFFICE

CERTIFICATE OF CORRECTION

PATENT NO. : 8,219,367 B2
APPLICATION NO. : 12/086762
DATED : July 10, 2012
INVENTOR(S) : Kyoichi Iwata et al.

It is certified that error appears in the above-identified patent and that said Letters Patent is hereby corrected as shown below:

In the Claims:

Claim 14, column 16, line 67, “a” should read as -- the --.

Claim 17, column 17, line 32, “caused by” should read as -- due to --.

Claim 17, column 17, line 37, “transfer vector of the point” should read as -- transfer vector of the movement of the point --.

Signed and Sealed this
Thirteenth Day of August, 2013

Teresa Stanek Rea
*Acting Director of the United States Patent and Trademark Office*